US011097182B1

(12) United States Patent
Behrmann

(10) Patent No.: US 11,097,182 B1
(45) Date of Patent: Aug. 24, 2021

(54) SKATEBOARD TRUCK HAVING ARCUATE PIVOT SURFACE

(71) Applicant: Russell Carl Behrmann, Miami, FL (US)

(72) Inventor: Russell Carl Behrmann, Miami, FL (US)

( * ) Notice: Subject to any disclaimer, the term of this patent is extended or adjusted under 35 U.S.C. 154(b) by 0 days.

(21) Appl. No.: 16/777,684

(22) Filed: Jan. 30, 2020

(51) Int. Cl.
*A63C 17/02* (2006.01)
*A63C 17/01* (2006.01)
*A63C 17/00* (2006.01)

(52) U.S. Cl.
CPC ..... *A63C 17/012* (2013.01); *A63C 17/0093* (2013.01); *A63C 2203/42* (2013.01)

(58) Field of Classification Search
CPC ..... A63C 17/02; A63C 17/0093
See application file for complete search history.

(56) References Cited

U.S. PATENT DOCUMENTS 5,263,725 A * 11/1993 Gesmer ..... A63C 17/0093 280/11.28
7,243,925 B2 * 7/2007 Lukoszek ..... A63C 17/0093 280/11.28
8,857,824 B2 * 10/2014 Miller ..... A63C 17/02 280/11.28
8,888,108 B1 * 11/2014 Beaty ..... A63C 17/0093 280/11.27
2006/0006622 A1 * 1/2006 Gesmer ..... A63C 17/012 280/87.042
2009/0250891 A1 * 10/2009 Stratton ..... A63C 17/0093 280/87.042
2013/0308887 A1 * 11/2013 Gesmer ..... B60B 27/0005 384/523
2014/0151972 A1 * 6/2014 Williams ..... A63C 17/0093 280/87.042
2017/0087441 A1 * 3/2017 Ivazes ..... A63C 17/012

* cited by examiner

*Primary Examiner* — Brian L Swenson

(57) ABSTRACT

An improved skateboard truck includes a baseplate, a hanger, and a kingpin assembly for securing the hanger to the baseplate. A first pivot surface is associated with the baseplate. A pivot plate is associated with the hanger. The pivot plate has an outer edge that defines a second pivot surface. The baseplate and the hanger are configured such that the second pivot surface engages the first pivot surface when the hanger is secured to the baseplate by the kingpin assembly. One of or both the first pivot surface and the second pivot surface has an arcuate profile that allows the baseplate to rock from side to side relative to the hanger.

15 Claims, 15 Drawing Sheets

SECTION A-A

SECTION B-B

SECTION C-C

SECTION D-D

SKATEBOARD TRUCK HAVING ARCUATE PIVOT SURFACE

FIELD OF THE INVENTION

The present invention generally relates to the field of skateboarding. Specifically, the invention relates to an improved skateboard truck as well as skateboards employing improved skateboard trucks.

BACKGROUND

Skateboards typically include front and rear trucks. The Skateboard trucks are employed to attach wheels to the underside of a footboard. The front truck supports a pair of front wheels attached to a front axle mounted near the front of the footboard, and a rear truck supports a pair of rear wheels attached to a rear axle near the back of the footboard. A skateboarder stands atop the footboard while the wheels roll along a surface to convey the skateboarder across the surface. In addition to attaching the wheels to the footboard, the trucks allow the footboard to pivot relative to the front and rear axles in response the skateboarder shifting his or her weight from side to side to steer the skateboard.

A typical skateboard truck includes a base plate, a hanger, and a kingpin assembly. The base plate is bolted to or otherwise secured to the underside of the footboard and the hanger is secured to the baseplate by the kingpin assembly. The kingpin assembly includes compressible bushings that allow the footboard to rock from side to side relative to the hanger in response to pressure applied to the sides of the footboard by the skateboarder riding the skateboard. A pivot stem protrudes from the hanger. When the hanger is secured to the base plate by the kingpin, the pivot stem is seated within a depression formed in the base plate known as the pivot cup. The pivot stem seated in this manner defines a pivot axis around which the axle supported by the hanger is allowed to rotate relative to the baseplate and hence the footboard itself. The pivot axis is arranged such that rotation of the footboard in a first direction relative to the hanger causes the wheel attached to the axle on the far side of the hanger to be thrust forward and the wheel attached to the axle on near side of the hanger to be pulled back, allowing the skateboard to turn in the direction in which the skateboarder is leaning.

In typical kingpin trucks the pivot stem contacts the pivot cup at essentially a single point. While allowing the hanger to rotate about the pivot axis defined by the pivot stem, this arrangement fails to restrict movement of the hanger relative to the footboard in directions outside the rotational plane of the pivot axis. This can lead to unwanted vibrations and instability especially when the skateboard is travelling at high speeds and/or over uneven terrain. Such instability can reduce the quality of the skateboarder's experience, and in the worst cases could lead to crashes.

SUMMARY OF THE INVENTION

The present invention relates to a skateboard having an improved truck assembly. The novel truck assembly improves skateboard performance by providing greater control and greater stability. For example a rider may achieve a tighter turn radius with the present truck without experiencing wheel bite.

A skateboard according to an embodiment of the invention includes a footboard, a base plate, a hanger and a kingpin. The baseplate is secured to an underside of the footboard. The hanger, which supports left and right axles, is secured to the base plate by the kingpin assembly. A first pivot surface is formed along the base of a pivot race or channel associated with the base plate. A pivot plate is associated with the hanger. An outer edge of the pivot plate forms a second pivot surface. When the hanger is secured to the base plate a portion of the pivot plate resides within the channel such that the second pivot surface rotationally engages the first pivot surface.

Further, a skateboard truck according to an embodiment of the invention includes a baseplate, a hanger, and a kingpin assembly. The kingpin assembly secures the hanger to the base plate. A first pivot surface is associated with the baseplate. A second pivot surface is defined by the outer edge of a pivot plate associated with the hanger. The base plate and the hanger are configured such that the second pivot surface engages the first pivot surface when the hanger is secured to the baseplate by the kingpin assembly. At least one of the first and second pivot surfaces has an arcuate cam-like profile that defines a range of motion that allows the baseplate to rock from side to side relative to the hanger in response to pressure applied to the sides of the skateboard by a skateboarder riding the skateboard on which the truck is installed.

Yet another embodiment of a skateboard truck assembly includes a base plate and a hanger. The hanger supports a left axle and a right axle along a wheel axis. The hanger includes a kingpin bore that extends through a portion of the hanger along a kingpin axis. A pivot plate associated with the hanger is offset from the wheel axis and forms an an acute angle with the kingpin axis. The pivot plate defines a convex arcuate pivot surface along an edge of the pivot plate. A first bushing is seated within a first bushing seat formed in a first surface of the hanger around the kingpin bore, and a second bushing is seated within a bushing seat formed in a second surface of the hanger around the kingpin bore, the first and second bushings each having axial bores along the kingpin axis. A kingpin having a proximal end secured to the base plate and a threaded distal end, is inserted through the first bushing bore, the hanger bore, and the second bushing bore along the kingpin axis. A kingpin nut is then rotatably secured to threaded end of the kingpin to secure the hanger to the base plate. A pivot race associated with the base plate is configured to receive a portion of the pivot plate when the hanger is secured to the base plate. The pivot race defines a convex inner pivot surface facing the convex outer pivot surface formed on the edge of the pivot plate. When the hanger is secured to the base plate, the convex outer surface of the pivot plate engages the convex inner surface within the pivot race.

DETAILED DESCRIPTION

Figure 1:
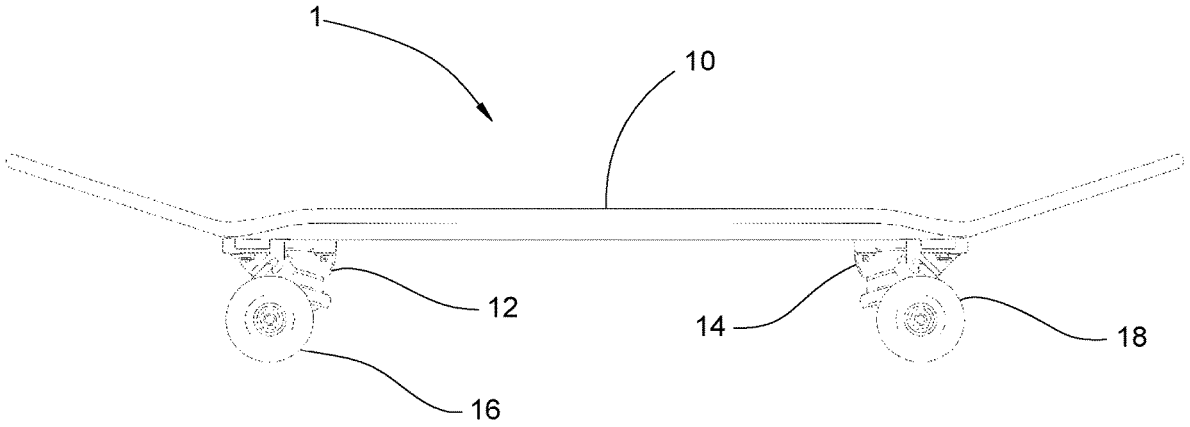
FIG. 1 is a side view of a skateboard employing skateboard trucks according to an embodiment of the invention.

Referring to FIG. 1, a skateboard 1 according to an embodiment of the invention comprises a footboard or deck 10, a front truck 12 and a rear truck 14. The front truck 12 includes a front axle that supports a pair of front wheels 16. The rear truck 14 includes a rear axle that supports a pair of rear wheels 18. The trucks 12, 14 allow the axles to rotate relative to the footboard 10 as a rider shifts his or her weight from side to side to steer the skateboard.

Figure 2:
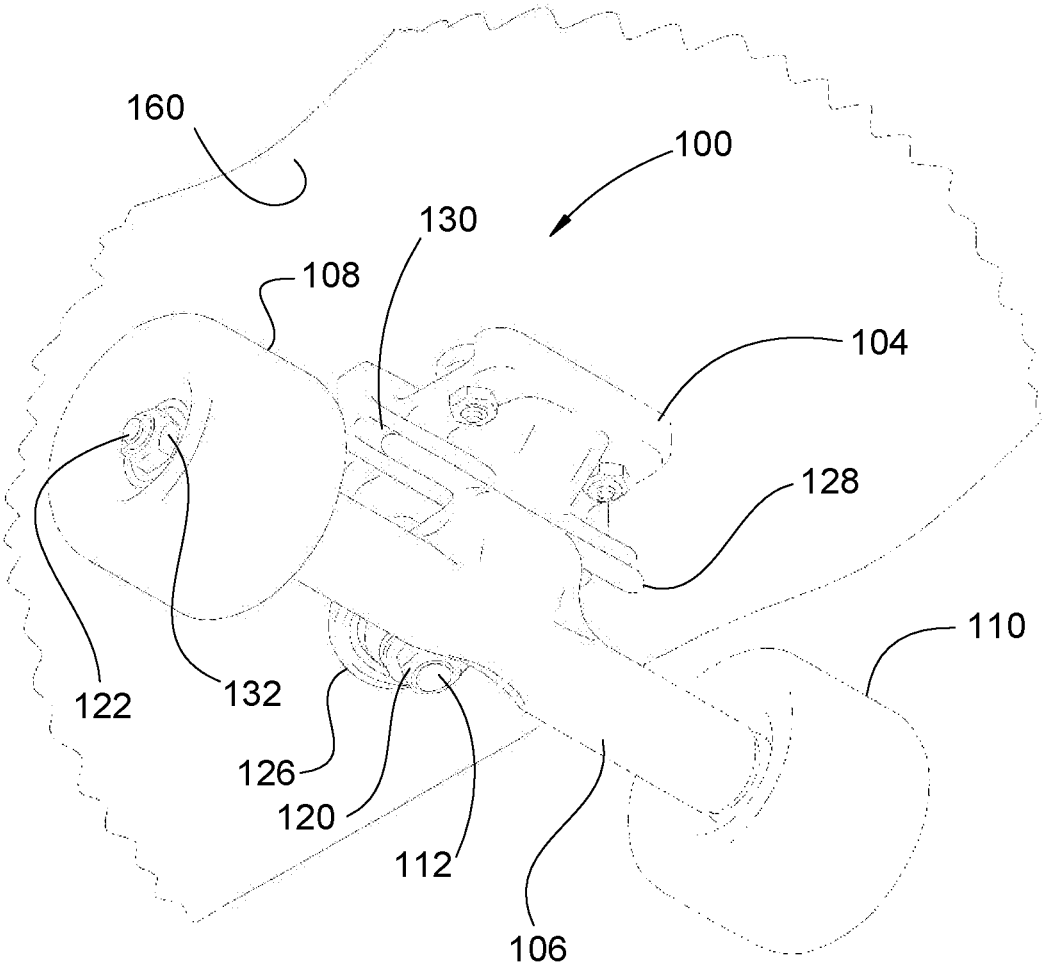
FIG. 2 is a perspective view of skateboard truck according to an embodiment of the inventions showing a front side of a truck assembly attached to the underside of a footboard.
Figure 3:
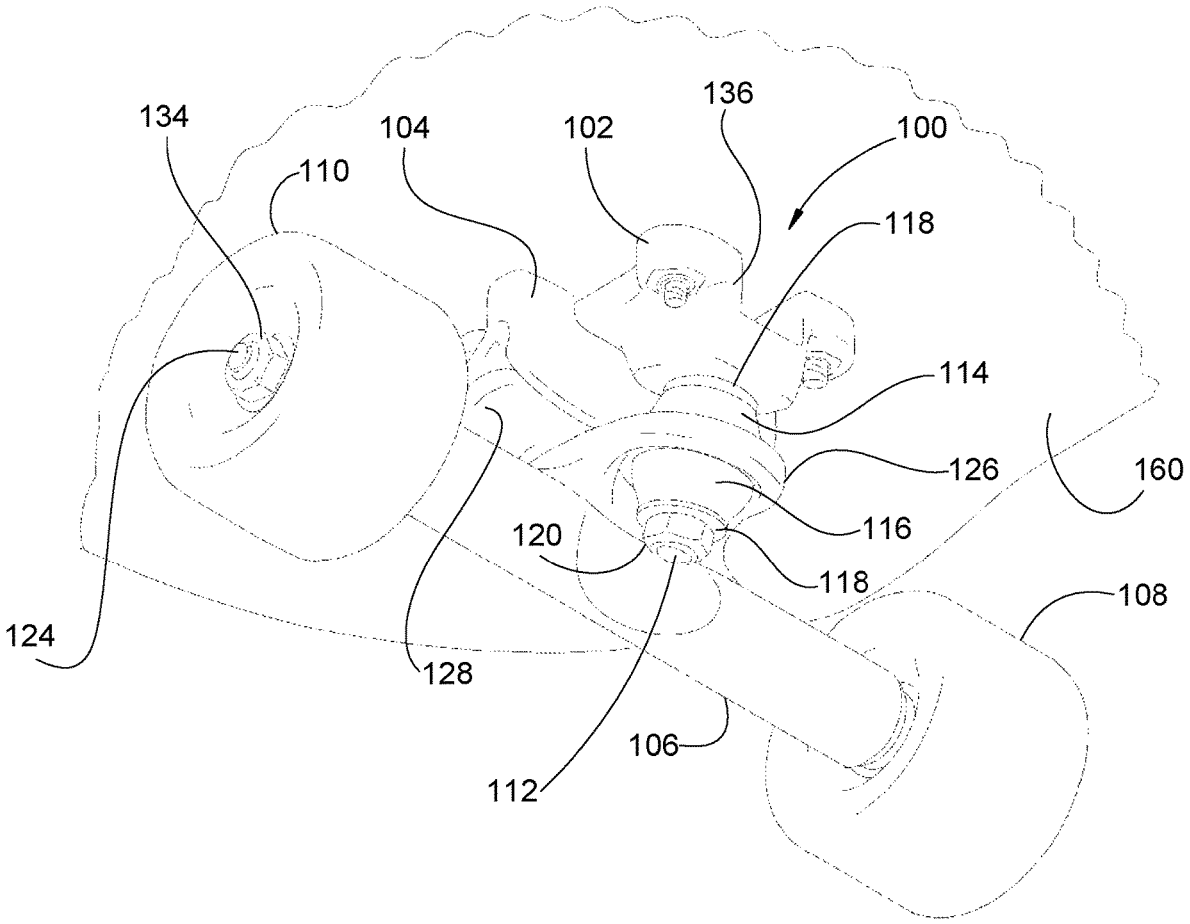
FIG. 3 is is perspective view of the skateboard truck of FIG. 2 showing the back side of the truck assembly attached to the underside of the footboard.
Figure 4:
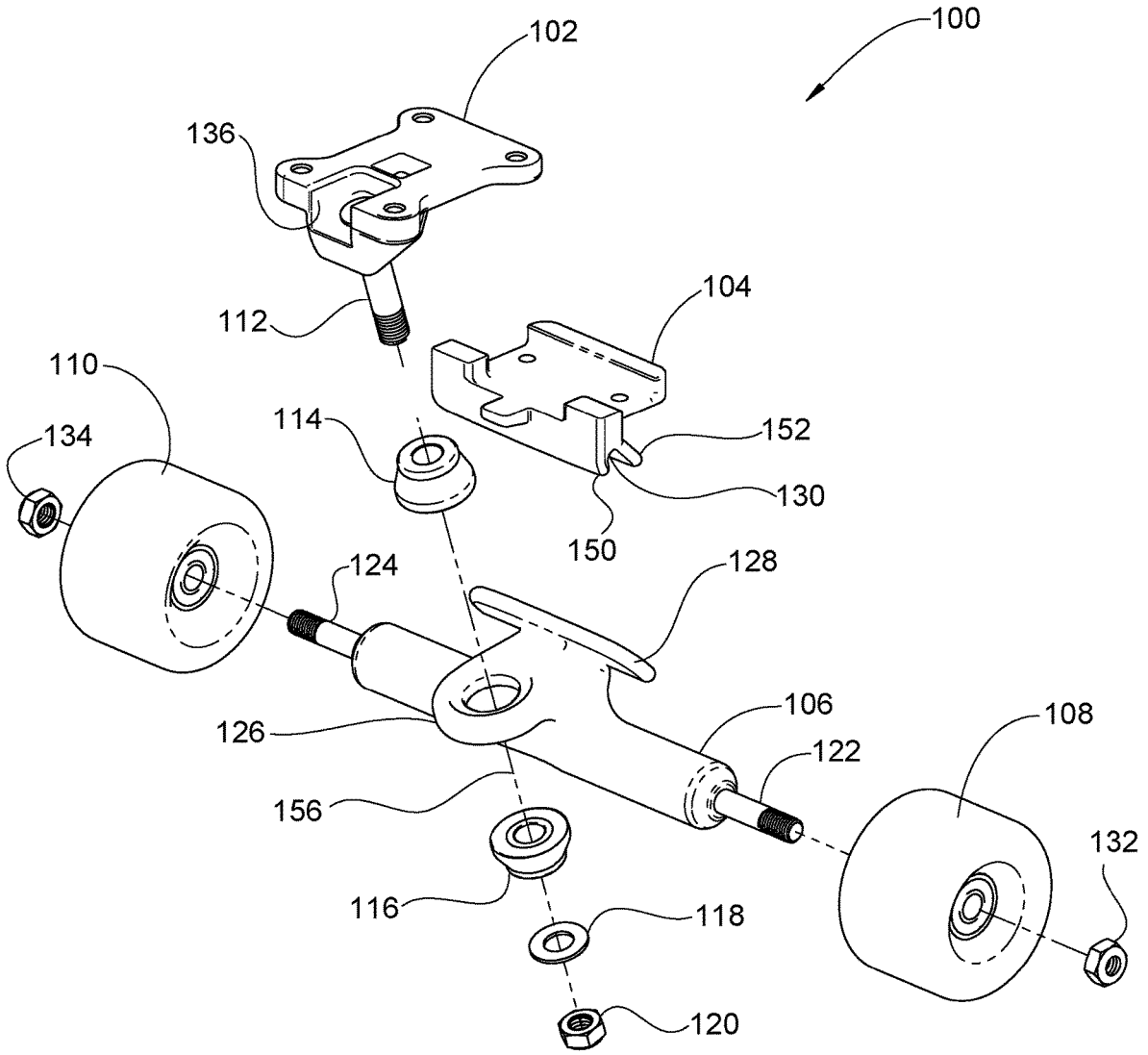
FIG. 4 is an exploded perspective view of a skateboard truck assembly according to an embodiment of the invention.

Turning to FIGS. 2-4, the main components of a skateboard truck 100 according to an embodiment of the invention include a base plate 102; a pivot-race plate 104; a hanger 106; a kingpin 112; upper and lower kingpin bushings 114, 116; a washer 118, and a kingpin nut 120. The hanger 106 supports a right axle 122 and a left axle 124. A right wheel 108 may be secured to the right axle 122 by a first wheel nut 132 and a left wheel 110 may be secured to the left axle 124 by a second wheel nut 134. The base plate 104 may be mounted on the underside of the footboard 160 of a skateboard. The pivot-race plate 104 may also be mounted on the underside of the footboard 160, partially overlapping the base plate 102. A kingpin recess 136 is form in the end of the base plate opposite the end overlapped by the pivot-race plate 104. The kingpin 112 may be inserted through a bore formed through the base plate 104 and secured therein by the enlarged head formed at the proximal end of the kingpin 112. The kingpin 112 is adapted to secure the hanger 106 to the base plate 104 as will be described below.

Figure 5:
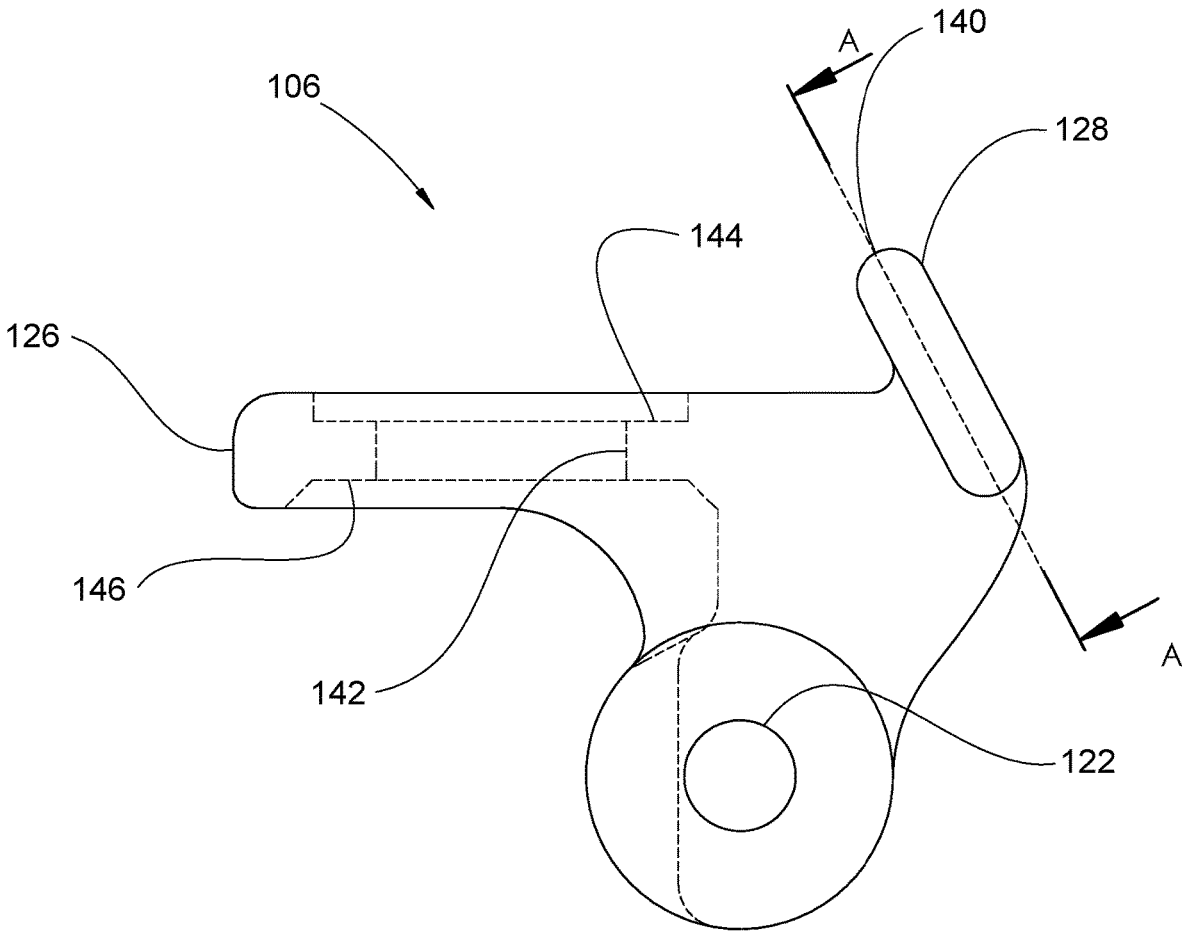
FIG. 5 is a side view of a hanger component of a skateboard truck assembly according to an embodiment of the invention.

Turning now to FIGS. 2-4 and 5 and 6, a side view of the the hanger 106 is shown in FIG. 5. The hanger 106 includes a kingpin flange 126 and a pivot plate 128. The kingpin flange 128 defines a kingpin bore 142 as well as an upper bushing seat 144 and a lower bushing seat 146. When the truck 100 is assembled, the kingpin 112 is inserted through base plate 102, the upper bushing 114, the kingpin flange 126, the lower bushing 116 and the washer 118. This kingpin assembly is then secured by the kingpin nut 120 which may be tightened over the threads formed at the distal end of the kingpin 112. The true shape of the pivot plate 128 is shown in the cross sectional view of FIG. 6. The pivot plate 128 has a convex arcuate upper edge that forms a cam-like pivot surface 140.

Figure 6:
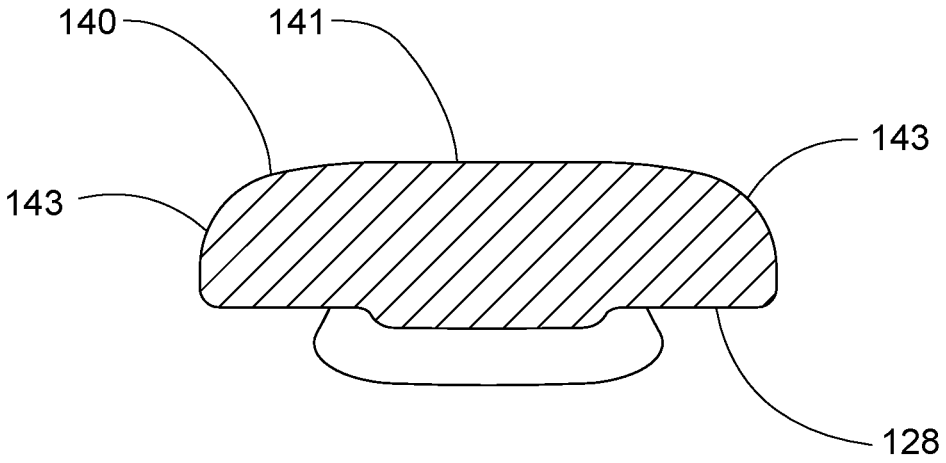
FIG. 6 is a cross sectional view of a pivot plate associated with the hanger shown in FIG. 5 taken along the line A-A.
Figure 7:
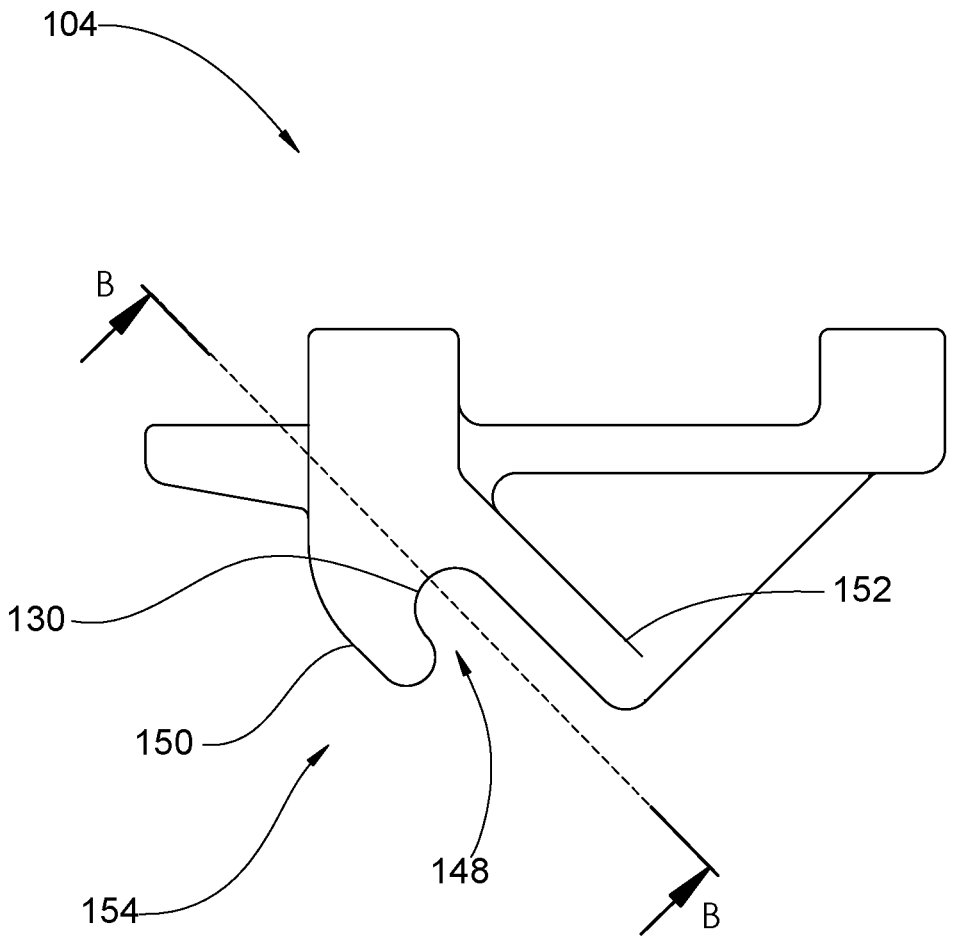
FIG. 7 is a side view of a race plate component of a skateboard truck assembly according to an embodiment of the invention.
Figure 8:
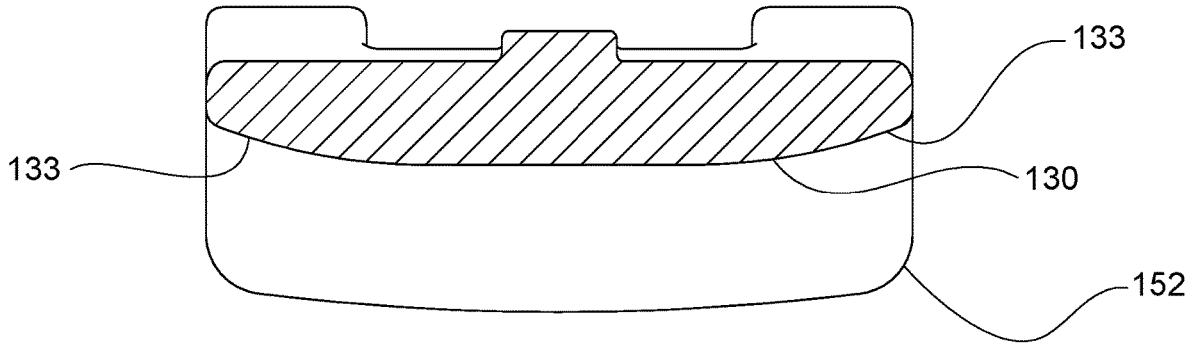
FIG. 8 is a cross sectional view of a race associated with the race plate shown in FIG. 7 taken along the line B-B.
Figure 9:
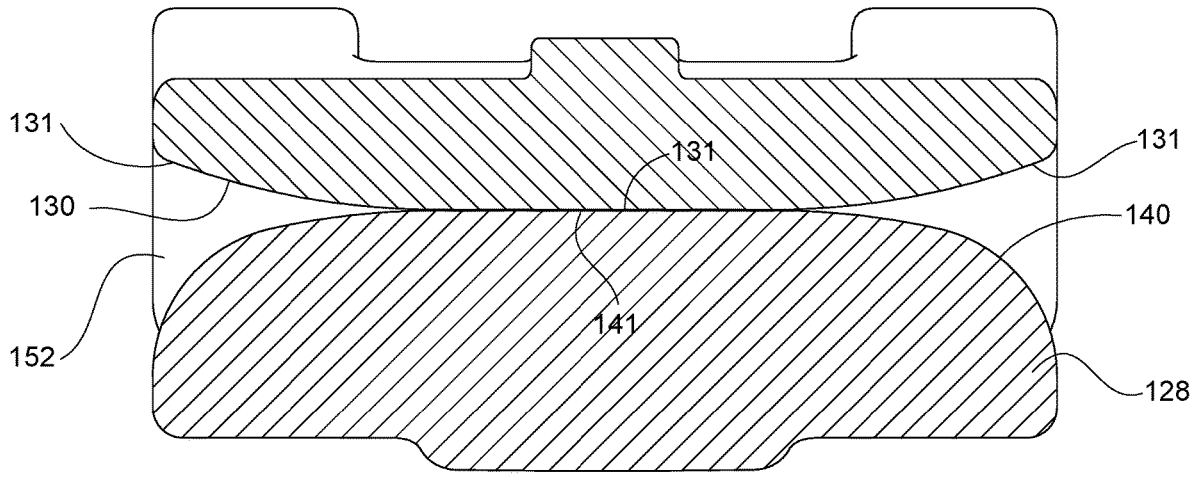
FIG. 9 is a cross sectional view of the pivot plate and the race plate of FIGS. 5 and 6 taken along the lines A-A and B-B, respectively, when the components are assembled.
Figure 10:
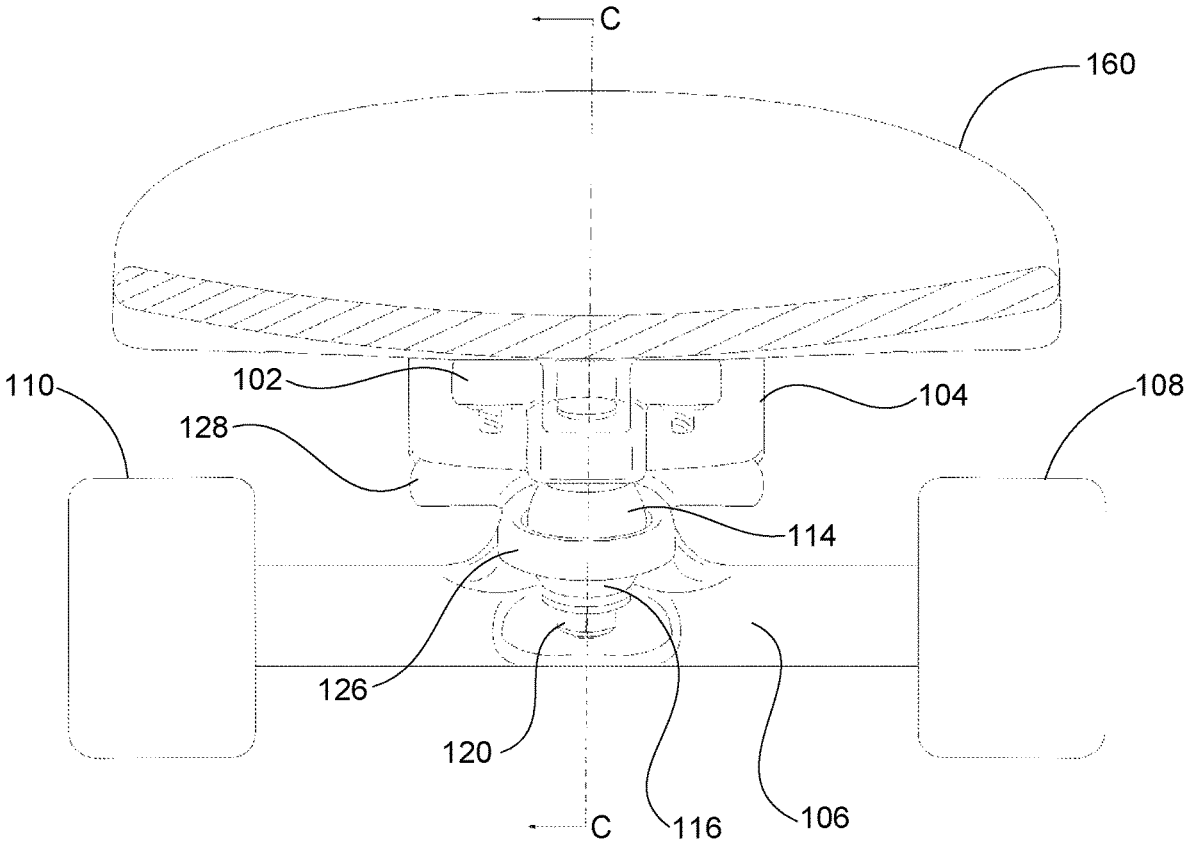
FIG. 10 is a front view of a skateboard employing a skateboard truck according to and embodiment of the invention.
Figure 11:
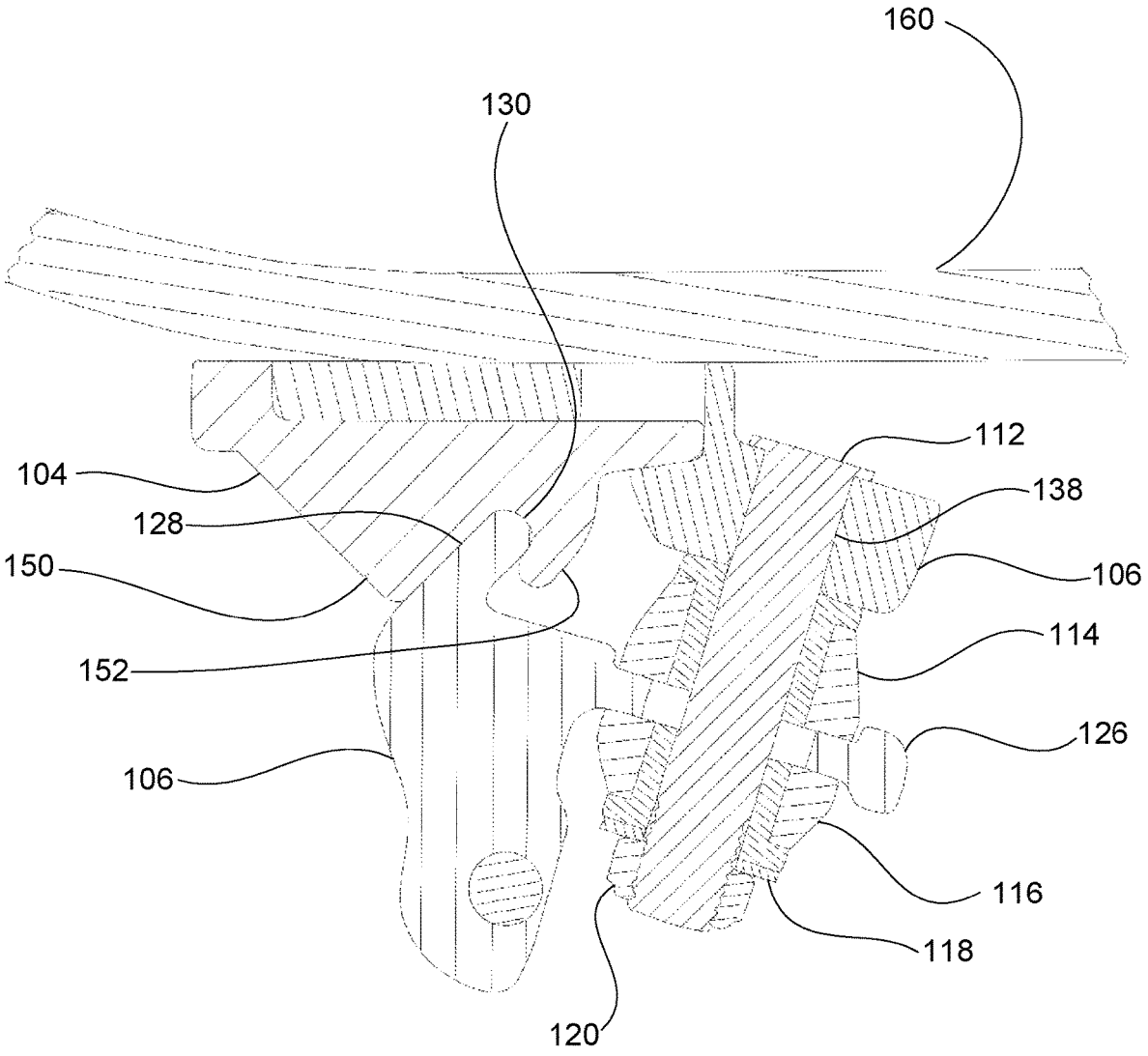
FIG. 11 is a cross sectional view of the skateboard truck assembly shown in FIG. 10 taken along the line C-C.

Turning now to FIGS. 2-4 and 7 and 8, a race 154 for receiving the pivot plate 128 is formed on an underside of the race plate 104. A generally planar front race guide plate 150 and a generally planar rear race guide plate 152 extend downward from the race plate 104. A channel or slot 148 is defined between the first and second race guide plates 150, 152. A race surface 130 is formed at the distal end of the channel or slot 148. As best seen in the cross sectional view of FIG. 8, the race surface 130 has a convex arcuate profile similar to, but the opposite of, the convex arcuate cam-like pivot surface 140 of the pivot plate 128 associated with the hanger 106 (FIGS. 5 and 6).

Turning now to FIGS. 2-3, and 9-12, when the various components of the truck 100 are assembled, the pivot plate 128 is inserted into the channel or slot 148 created between the first race guide plate 150 and the second race guide plate 152. The convex arcuate cam-like surface 140 of the edge of the pivot plate 128 abuts the oppositely convex bottom surface 130 of the pivot-race 154. The abutting convex surfaces 130, 140 of the race 154 and the pivot plate 128 allow for rotary movement of the pivot plate 128 relative to the race plate 104. At the same time, the front and rear race guide plates 150, 152 restrict unwanted motion between the pivot plate 128 and the faceplate outside of the plane of rotation defined by the race 154 and the pivot plate 128, thereby increasing the stability of a skateboard employing the inventive truck 100. Stability is further enhanced by the shape of the two pivot surfaces 130, 140 formed within the race 154 and along the upper edge of the pivot plate 128. As best seen in the cross sectional view of FIG. 9, each arcuate pivot surface 130, 140 has a relatively flat center portion 131, 141, and more sharply rounded portions 133, 143 at each end. The center position shown in FIG. 9, with the relatively flat portions of the pivot surfaces engaging one another, corresponds to straight ahead forward travel. In this position, greater force is necessary to be applied to the sides of the footboard to cause the race plate 104 to pivot relative to the hanger 106 than when the more rounded portions of the pivot surfaces 130, 140 are engaged with one another. The shapes of the two surfaces 130, 140 dynamically distribute the pivot point between the base plate 104 and the hanger 106 from side to side as the rider shifts his or her weight to steer the skateboard. Distributing the pivot point in this manner causes the footboard to lift relative to the hanger during turns. This provides greater clearance between the footboard and the wheels, reducing wheel bite, or eliminating it altogether. The shape of the pivot surfaces 130, 140 also provides a natural return to center when the rider has completed a turn. Thus, a skateboard employing the truck disclosed herein will tend to remain in the centered position, especially while the skateboard is traveling straight forward and at higher speeds. The flatter center portion of the two surfaces is inherently more stable than the rounded ends, providing greater stability and eliminating wheel wobble. When turning, however, the more rounded ends 133, 143 of the pivot surfaces 130, 140 will be engaged. Under these conditions, the truck will be far more responsive to the shifting weight of the rider. Thus, a skateboard employing the truck disclosed herein exhibits the dual advantages of increased stability during straight higher speed travel and increased responsiveness and maneuverability during turns. Still another advantage of the disclosed truck is that the geometry of the pivot surfaces 130, 140 creates greater clearance between the wheels and the footboard during turns. As the rider leans toward one side or the other, the pivot point between the race 104 plate and the hanger 106 extends outward from the center position. This shortens the tilted side's radius, extending the range of the pivot from side to side. With this arrangement, maximum bushing compression occurs before the edge of the footboard reaches the wheels, preventing the board from contacting the wheels. This, and the greater clearance reduces and/or eliminates wheel bite during sharp turning maneuvers.

Figure 12:
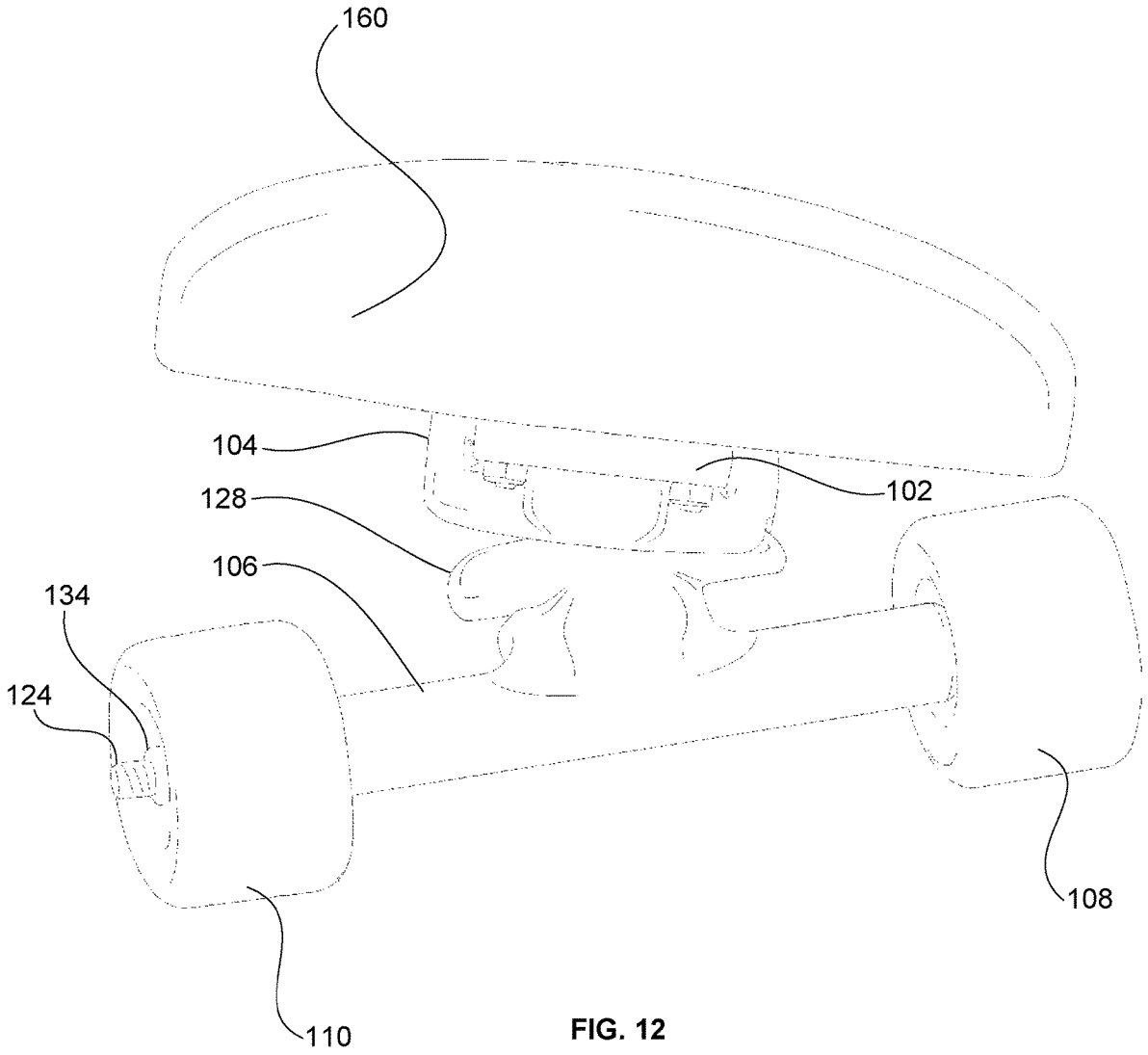
FIG. 12 is a front view of a skateboard employing a skateboard truck according to an embodiment of the invention showing the orientation of the hanger relative to the race plate and footboard when a rider leans to one side to steer the skateboard.

The upper and lower bushings 114, 116 are made of a compressible and resilient material such that the bushings may deform slightly, then spring back to their original shape in response to a rider shifting his or her weight from side to side on the footboard 160 to steer the skateboard. As the rider leans to one side or the other, the upper and lower bushings 114, 166 compress on the side to which the rider is leaning. Assuming that the wheels of the skateboard remain on level ground, the shifting weight of the rider causes the arcuate surface 130 of the race 154 to rock back and forth over the arcuate surface 140 of the edge of the pivot plate 128. Thus, as the rider leans to one side, the footboard 160 tilts in the direction in which the rider is leaning, as shown in FIG. 12. Due to the angle of the pivot plate 128 and the race 154 relative to the kingpin axis 156, the altered angular relationship between the pivot plate 128 and the race plate causes hanger 106 to rotate slightly relative to the footboard 160, drawing the wheel 108 back while pushing the wheel 110 forward, allowing the rider to steer the skateboard in the direction of the rider's lean. A similar, but opposite effect is achieved when the rider leans in the opposite direction.

Figure 13:
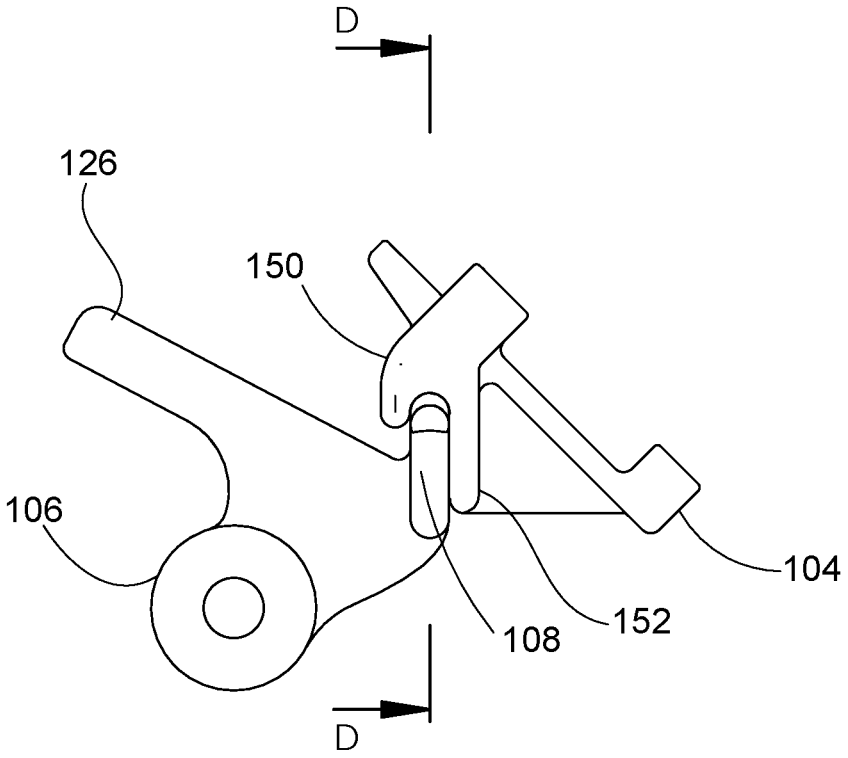
FIG. 13 is a side view of a skateboard truck assembly according to an embodiment of the invention.
Figure 14:
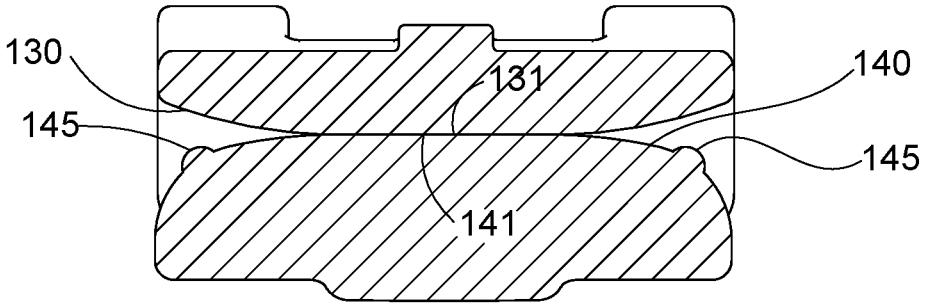
FIG. 14 is a cross sectional view of the skateboard truck assembly of FIG. 13 taken along the line D-D.
Figure 15:
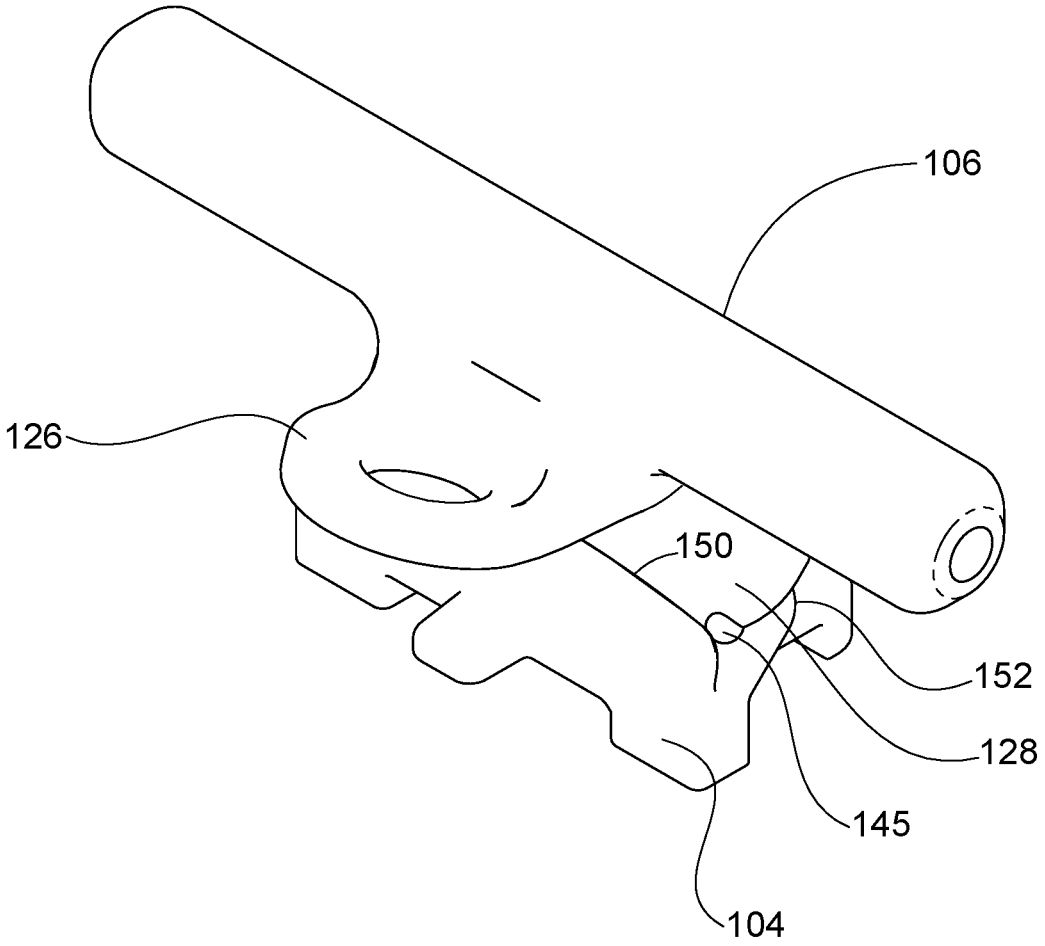
FIG. 15 is a perspective view of the skateboard truck assembly of FIG. 13.

An alternative embodiment of an improved skateboard truck is shown if FIGS. 13-15. The skateboard truck of FIGS. 13-15 is similar to that described above and show in FIGS. 1-12. Like elements have been given the same reference numbers. The main difference in the embodiment shown in FIGS. 13-15 is the addition of mechanical stops 145 formed on the pivot plate 128. The mechanical stops 145 limit pivot range of the base plate relative to the hanger. The mechanical stops 145 are a further protection against wheel bite during extreme sharp turning maneuvers.

The advantages of employing a skateboard truck according to an embodiment of the present invention include an increased range of motion including a 2' 6"turning radius, the elimination of wheel bite, and the elimination of high speed wobble. The abutting arcuate surfaces 130, 140 result in an inherently smoother ride. The arcuate surfaces 130, 140 cause the pivot to rise during turns as opposed to dropping as in prior art kingpin trucks, thereby eliminating wheel bite. The present truck does not uniquely depend on the condition of the king pin bushings and the king pin angle as do traditional king pin trucks, eliminating the tradeoff between maneuverability and stability inherent in tradition king pin trucks.

Various embodiments of the invention have been described and illustrated; however, the description and illustrations are by way of example only. Other embodiments and implementations are possible within the scope of the invention and will be apparent to those of ordinary skill in the art. Therefore, the invention is not limited to the specific details of the representative embodiments and illustrated examples in this description. Accordingly, the invention is not to be restricted except as necessitated by the accompanying claims and their equivalents.

What is claimed is:

1. A skateboard comprising:

a footboard;

a baseplate secured to an underside of the footboard;

a pivot channel associated with the baseplate forming a first pivot surface within the channel along a base of the channel;

a hanger supporting left and right axles;

left and right wheels mounted on the left and right axles, respectively;

a pivot plate associated with the hanger having an outer edge that forms a second pivot surface; and a kingpin assembly securing the hanger to the baseplate such that a portion of the pivot plate associated with the hanger resides within the channel with second pivot surface engaging the first pivot surface, wherein the first pivot surface formed along the base of the pivot channel has a convex arcuate profile.

2. The skateboard of claim 1 wherein the second pivot surface formed by the outer edge of the pivot plate has a convex arcuate profile.

3. The skateboard of claim 1, wherein each of the first pivot surface and the second pivot surface has a convex arcuate profile, wherein a center portion of each arcuate profile is relatively flat, having a longer arcuate radius than left and right ends of the first and second pivot surfaces.

4. The skateboard of claim 3 wherein the pivot channel is formed between a first guide surface and a second guide surface, wherein the first and second guide surfaces restrict movement of the pivot plate to rotary movement within a plane of the pivot plate.

5. The skateboard of claim 1 wherein the pivot channel is formed on a separate pivotchannel plate attached to the base plate.

6. The skateboard of claim 5 wherein the kingpin assembly defines a kingpin axis, and the wherein the plane defined by the pivot plate intersects the kingpin axis at an acute angle.

7. The skateboard claim 1 wherein the pivot plate is integrally formed with the hanger and defines a plane that is offset from an axis defined by the left and right axles.

8. A skateboard truck comprising:

a baseplate;

a hanger;

a kingpin assembly for securing the hanger to the base plate;

a first pivot surface associated with the baseplate;

a pivot plate associated with the hanger, the pivot plate having an outer edge that defines a second pivot surface; and the base plate and the hanger configured such that the second pivot surface engages the first pivot surface when the hanger is secured to the baseplate by the kingpin assembly;

wherein at least one of the first pivot surface and the second pivot surface having an arcuate profile that allows the baseplate to rock from side to side relative to the hanger, and wherein both the first pivot surface and the second pivot surface have arcuate profiles.

9. The skateboard truck of claim 8 wherein the arcuate profiles of each of the first and second pivot surfaces has a relatively flat long radius center portion and relatively rounder short radius ends.

10. The skateboard truck of claim 9 wherein the hanger supports an axle for mounting skateboard wheels and wherein the pivot plate defines a plane that is offset from the axle and which forms an acute angle with a kingpin axis defined by the kingpin assembly.

11. The skateboard truck of claim 8 further comprising a separate race plate attached to the base plate, the first pivot surface being located at the base of a race channel formed between a first race guide and a second race guide.

12. The skateboard of claim 11 wherein the race channel is configured to receive a portion of the pivot plate allowing the second pivot surface on the edge of the pivot plate to engage the first pivot at the base of the race channel, the first race guide and second race guide restricting movement of the pivot plate outside a plane defined by the race channel.

13. A skateboard truck assembly comprising:

a base plate;

a hanger supporting a left axle and a right axle along a wheel axis, the hanger defining a kingpin bore extending through a portion of the hanger along a kingpin axis;

a pivot plate associated with the hanger offset from the wheel axis and forming an acute angle with the kingpin axis, the pivot plate defining a convex arcuate first pivot surface along an edge of the pivot plate;

a first bushing seated within a first bushing seat formed in a first surface of the hanger around the kingpin bore and a second bushing seated within a bushing seat formed in a second surface of the hanger around the kingpin bore, the first and second bushings having axial bores formed therethrough;

a kingpin having a proximal end secured to the base plate and a threaded distal end, the kingpin extending through the first bushing bore, the hanger bore, and the second bushing bore along the kingpin axis;

a kingpin nut adapted to rotatable engage the threaded end of the kingpin to secure the hanger to the base plate;

a pivot race associated with the base plate configured to receive a portion of the pivot plate, the pivot race defining a convex inner second pivot surface facing the convex outer pivot surface formed on the edge of the pivot plate, the convex outer pivot surface of the pivot plate engaging the convex inner pivot surface within the pivot race when the when the hanger is secured to the base plate.

14. The skateboard truck assembly of claim 13 wherein the pivot race comprises a slot formed between a front guide and a rear guide arranged to receive the pivot plate associated with the hanger and to restrict movement of the pivot plate to rotary movement of the pivot plate within the pivot race.

15. The skateboard truck assembly of claim 13 wherein each of the first and second pivot surfaces has a convex arcuate profile that includes a relatively flat center portion and more sharply rounded ends.

* * * * *